US005316182A

United States Patent [19]

Lee et al.

[11] Patent Number: 5,316,182

[45] Date of Patent: May 31, 1994

[54] SCENTED TOY JEWELRY USING WATER SPRAYED OVER A SCENTED BEAD

[75] Inventors: James S. W. Lee, Long Island, N.Y.; Chiu K. Kwan, Kowloon, Hong Kong

[73] Assignee: G.J. Associates, Ltd., Monrovia, Liberia

[21] Appl. No.: 821,359

[22] Filed: Jan. 15, 1992

[51] Int. Cl.[5] ..... A63H 33/00; B67D 5/00

[52] U.S. Cl. ..... 222/78; 222/175; 222/630; 222/214; 446/475; 239/310; 63/1.1; 63/DIG. 2

[58] Field of Search ..... 63/1.1, 2, DIG. 2; 222/78, 175, 383, 630, 214, 145; 446/475, 483; 293/310, 314, 10; 424/76.3, 76.4

[56] References Cited

U.S. PATENT DOCUMENTS

| | | | |
|---|---|---|---|
| 1,644,486 | 10/1927 | Muller | 63/DIG. 2 |
| 2,218,790 | 10/1940 | Gifford | 239/310 |
| 2,615,758 | 10/1952 | Alexander | 222/78 |
| 2,868,586 | 1/1959 | Croce | 63/1.1 |
| 3,605,437 | 9/1971 | Litton | 63/1.1 |
| 3,759,284 | 9/1973 | Crowley | 239/310 |
| 4,406,296 | 9/1983 | Wexler | 63/2 |
| 4,911,364 | 3/1990 | Irie | 222/79 |
| 5,172,863 | 12/1992 | Melone | 446/475 |

FOREIGN PATENT DOCUMENTS

| | | | |
|---|---|---|---|
| 411669 | 6/1922 | Fed. Rep. of Germany | 446/475 |

*Primary Examiner*—Flemming Saether

*Attorney, Agent, or Firm*—Laff, Whitesel, Conte & Saret

[57] ABSTRACT

A toy in the form of jewelry has a water compartment, a pump or an atomizer, and a source of a perfume scent which is released when sprayed with water. The source of the scent is preferably a simulated jewel containing a bead of scent releasing material. The simulated jewel may be replaced when the scent is exhausted.

16 Claims, 7 Drawing Sheets

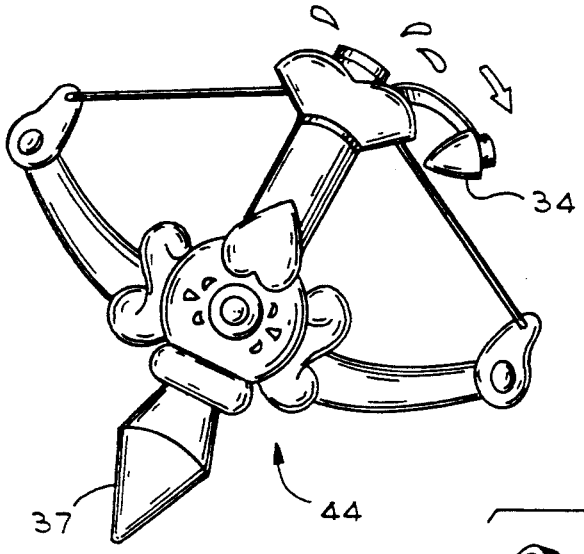
FIG.3B
FIG.3C
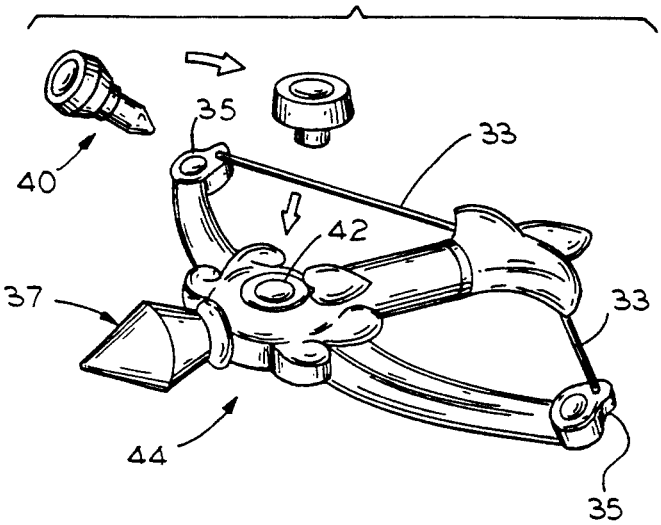
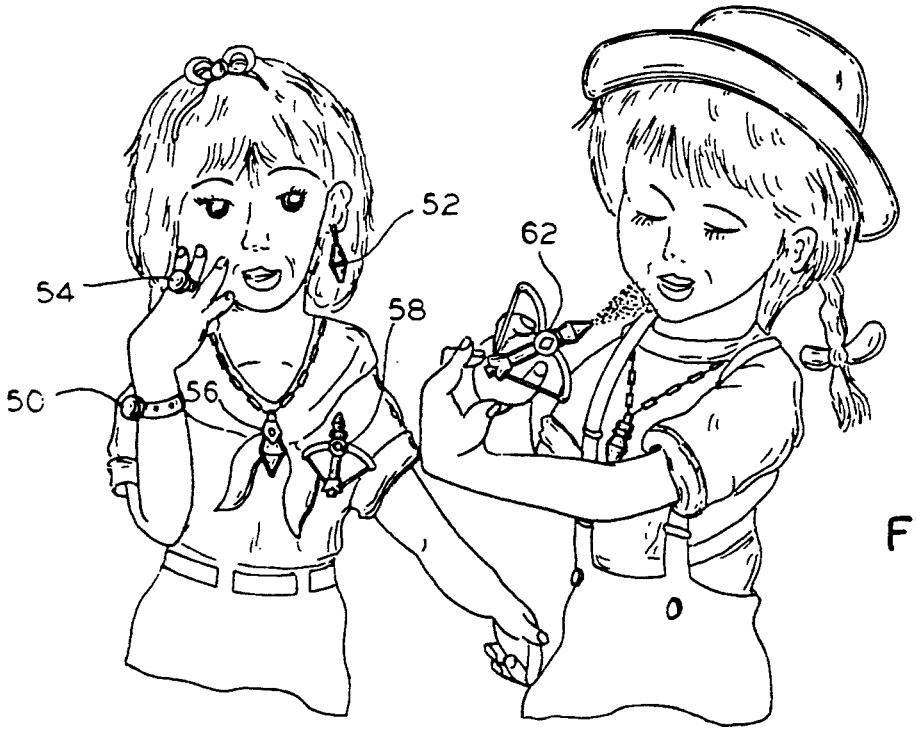
FIG.4

SCENTED TOY JEWELRY USING WATER SPRAYED OVER A SCENTED BEAD

This invention relates to toy jewelry and more particularly to toys which issue a scented spray upon demand.

Children like to play dress-up games where they adorn themselves in costumes which are suggestive of storybook, cartoon, video, or purely imaginative characters. Among other things, such dress-up games may involve wearing jewelry, perfume, or the like. If perfume is involved, the parents would like to have a source of scent in combination with something else which may function as a toy after the perfume is exhausted. Since perfume appeals to girls, jewelry is an ideal toy for later play after the scent disappears.

Another consideration is the amount of action which may be combined with a toy. For example, a perfume which is delivered from a spray bottle is less interesting to the child than a more imaginative toy which sprays the perfume from something unusual, such as a bow and arrow.

From the manufacturer's view point, it is desirable to provide a toy which may be modified to provide multiple appeal so that an investment in designs, piece parts, and the like may be combined in different ways to produce many different toys. For example, the same appearance or piece parts may be used to make such as diverse jewelry pieces as brooches, pendants, lockets, finger rings, charms, earrings, barrettes, or the like. In particular, it may be desirable to have a number of these kinds of toys in a single blister pack so that the child has a matched set of jewelry pieces. If so it is good to provide jewelry which fits in with graphics printed on the blister card. For example, a picture of a little girl printed on a backing card might be wearing the toy earrings, rings, a pendant, or the like.

These and other considerations are further enhanced if the perfume bottles on the toy appear to have a gem stone appearance. Also, it would be well if the toys have multiple uses. For example, if the toy looks like a bow and arrow, the perfume may be sprayed by pretending to shoot an arrow. Then, the toy has a continuing appeal as a toy bow and arrow long after the perfume is exhausted.

In keeping with an aspect of the invention, toys of different shapes and highlight details may be made as a child's size brooch with an elegant design in the shape of a bow, for example, with either a pull or a push spray action. The arrowhead may be a flat shape or a perfume bottle made of transparent or semi-transparent crystal "gems", perhaps in different hot colors. Larger sizes may be designed for a child to wear as a pendant-/locket. Smaller sizes may be a finger ring, a charm hanging from a bracelet, or a pair of earrings.

Preferred embodiments of the invention are shown in the attached drawings wherein:

FIGS. 1A-1C have plan views of three different designs of bow and arrow combinations;

FIGS. 3A-3C illustrate three steps in the use of the bow of FIGS. 1A-1C;

FIG. 4 illustrates two small girls using the inventive jewelry;

The invention avoids a use of scented liquids since there may be refills which may be spilled and which may be awkward for small children to use. If the child spills water, there is not the same kind of a problem. Therefore, the scented source may be in the form of solid beads with a scent or fragrance in a coating which is dissolvable in water. A manufacturer of the type of bead which may be used in this invention is Toshin Kasei Co. Ltd. 7-5, 4-chome Nihonbashi Honcho, Chuo-Ku, Tokyo 103, Japan. The center of the bead should be made of material which cannot be dissolved in water. Thus, the scent is released when the bead comes into contact with water. A little girl fills up her bow brooch with water. When this water is pumped through part of the toy (such as an "arrowhead") a scented mist is sprayed out (as by "shooting" the arrow). Eventually the bead/concentrate is exhausted, but the little girl still owns a piece or set of jewelry. Or she may still play with a brooch in the form of a water spray, without the scent, somewhat as a squirt gun.

Figure 1A:
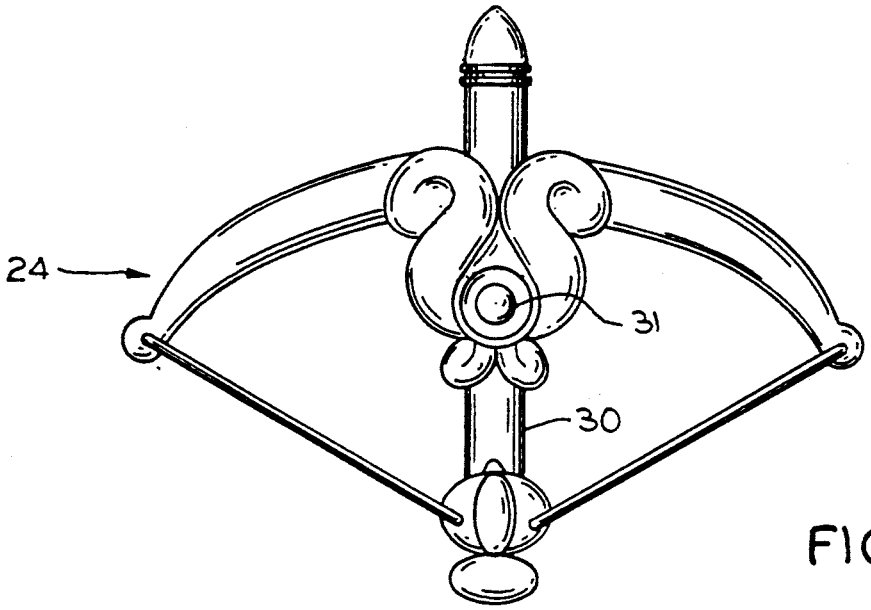
Figure 1B:
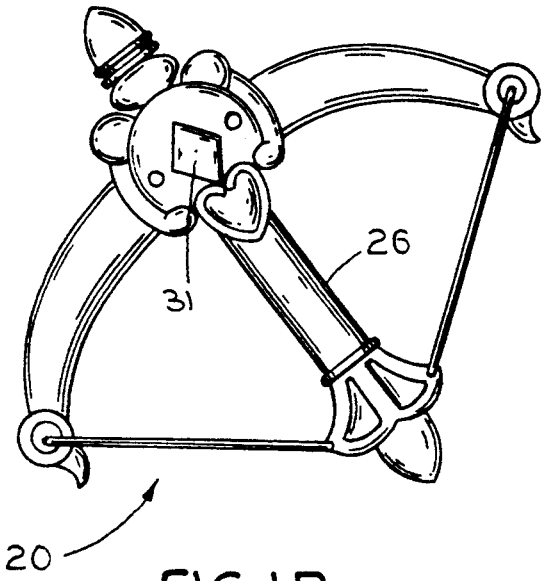
Figure 1C:
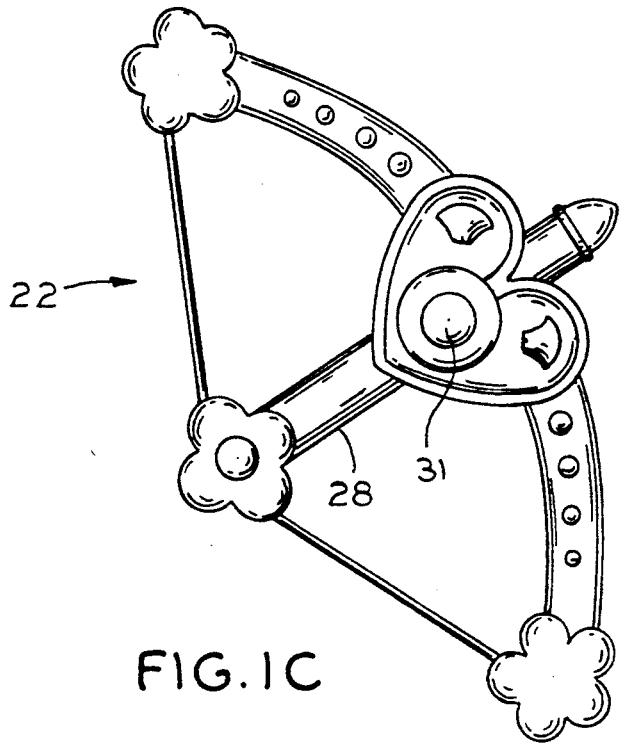

In FIGS. 1A-1C, three different designs 20, 22, 24 of a bow and arrow. In each case the arrow 26, 28, 30 may be a container for water. Or it could be a disguised piston which may be pulled back to fill a cylinder with water and pushed forward to squirt the water out of the arrowhead. The scented pellet may be dropped into the far end of the water containing cylinder by unscrewing the arrow head, inserting the scented pellet and reattaching the arrowhead.

Figure 2A:
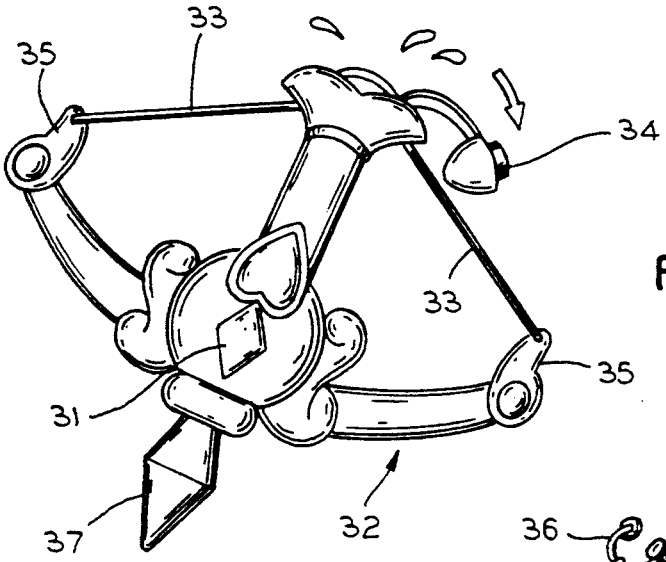
FIGS. 2A-2C illustrate the operation of the bow and arrow combinations of FIGS. 1A-1C and alternative use as an earring.
Figure 2B:
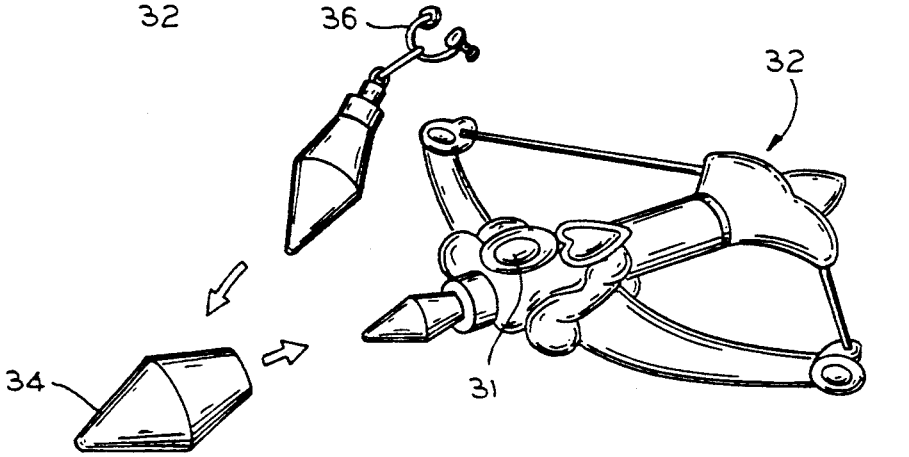
Figure 2C:
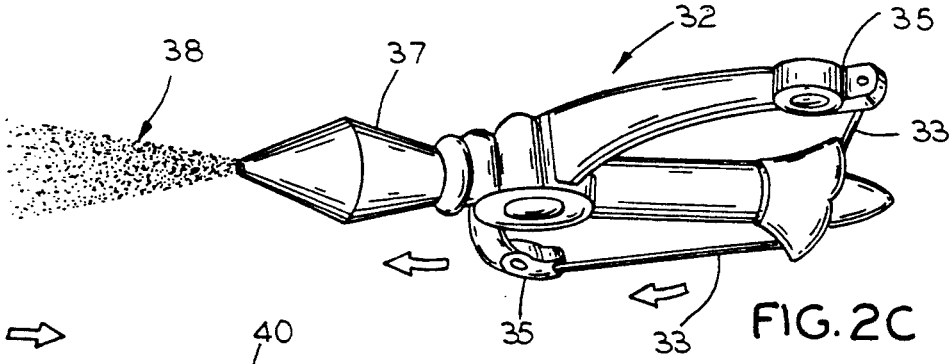

In FIG. 2, a brooch in the form of a bow and arrow combination 32 is shown with a stopper 34 which may be removed to fill the chamber with water. At 37, there is a replaceable simulated jewel carrying the scented pellet which may be connected to any suitable jewelry findings, such as earring clamp 36, or to an arrow of the brooch. The bow string 33, 33 may be pulled to pivot lever arms 35, 35, thereby operating a pump (not shown) to issue a spray 38. In the alternative, the jewelry item may have a centrally located diaphragm 31 which may be pushed to issue the spray 38 through the jewel 37, and past the scented bead therein, to the ambient atmosphere. By way of example, the jewel is here shown as issuing a spray 38 when the water is forced from the bow and arrow 32.

Figure 3A:
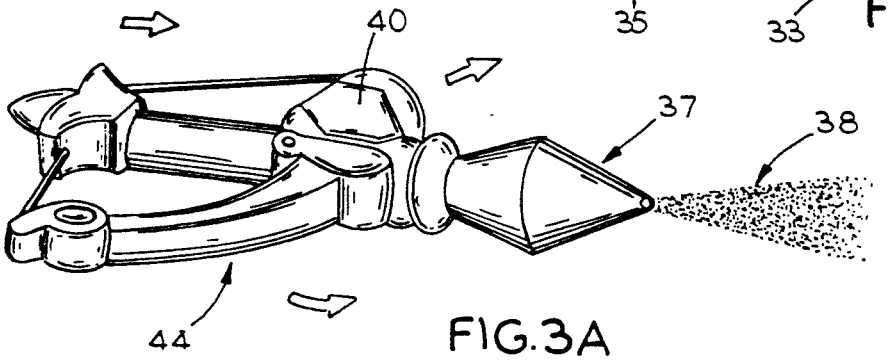

In FIGS. 3A-3C, a stopper 34 is removed in order to fill the arrow with water. The scent pellet 40 may be inserted into a chamber 42 at an intersection of the bow and arrow 44. When the spray is issued from the jewel 37, the water is forced out of the tip end of the arrow. The forced water passes the pellet 40, picking up the scent located in the pellets coating.

FIG. 4 illustrates several of the many ways that the inventive jewelry may be used, such as: a bracelet 50; earrings 52, a ring 54, a pendant 56, or as a pin 58. The girl wearing the hat is shown spraying herself with a bow and arrow 62 type of jewelry.

The toy of FIG. 4 shows a plurality of different articles, 50, 52, 54, 56, 62 which may have coordinated designs and which may be mixed or matched when worn by a child. These articles are here shown as pieces of jewelry. Any suitable and known means such as chains, pin backs, earring clips, or the like may be used in order to wear these articles as jewelry items. Thus, any of many associated parts of the articles may be worn as pendants, earrings, rings, pins, and the like.

Figure 5B:
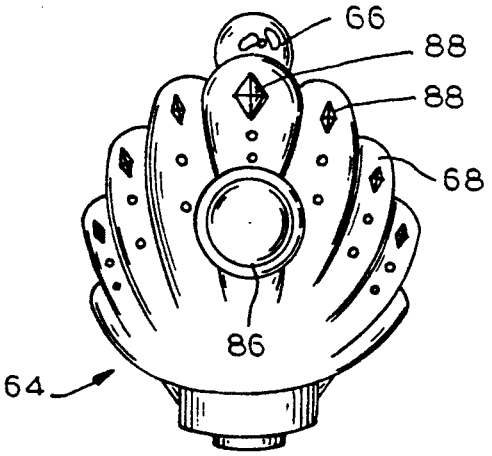
FIGS. 5A-5C illustrate a different piece of jewelry made of a pair of clam shells which use a pinch type of spray device.
Figure 5A:
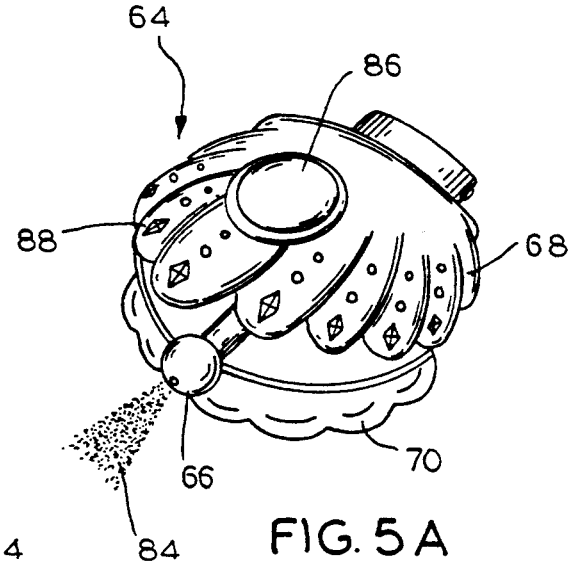
Figure 5C:
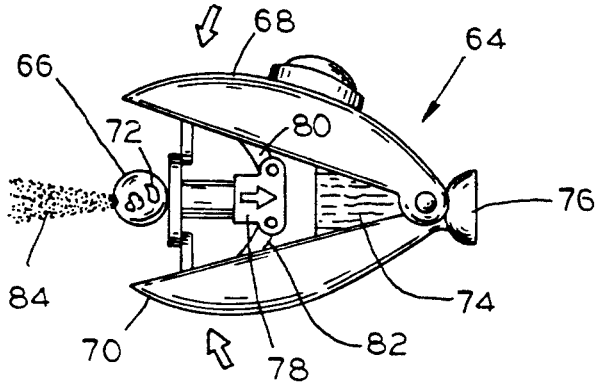

FIGS. 5A-5C show another type of jewelry item 64, with clam shells 68, 70 designed to be squeezed together in order to issue a spray. A simulated pearl 66 containing a scented bead 72 adds a scent to water passing through it. A water compartment 74 is built into the interior of the clam shells 68, 70 and is filled by removing a plug at 76. An atomizer-pump 78 is controlled by two lever arms 80 and 82, arm 80 being connected to upper clam shell 68 and arm 82 being connected to lower clam shell 70. When the shells 68, 70 are squeezed together, arms 80, 82 operate pump 78 to issue a spray 84 of water through pearl 66 containing scented bead 72. To enhance the jewelry effect, any suitable number of simulated jewels 86, 88 may be mounted at suitable locations on clam shells 68, 70.

Figure 6A:
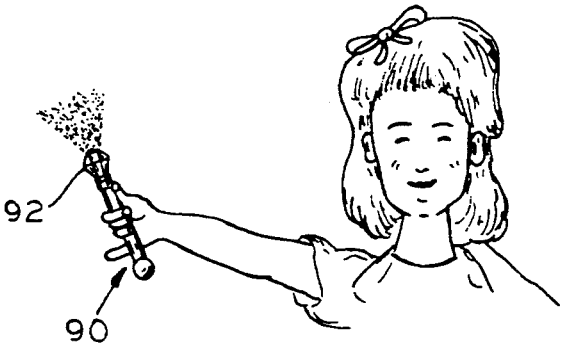
FIGS. 6A-6B illustrate a hand toy which a child might use as a scepter or magic wand.
Figure 6B:
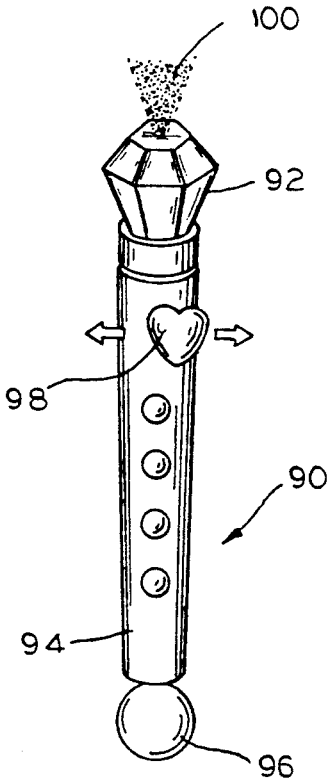

FIGS. 6A-6B illustrate a different kind of jewelry such as a toy scepter or wand 90. A jewel 92 contains a scented bead. The handle 94 contains a water compartment which is filled by removal of a stopper or an actuation of a plunger at 96. A thumb controlled member 98 sprays water through jewel 92, past the enclosed scented bead, and out into the atmosphere as scented spray 100 The girl in FIG. 6 might be playing as a fairy godmother waving her magic wand or as the Queen holding her scepter.

Figure 7B:
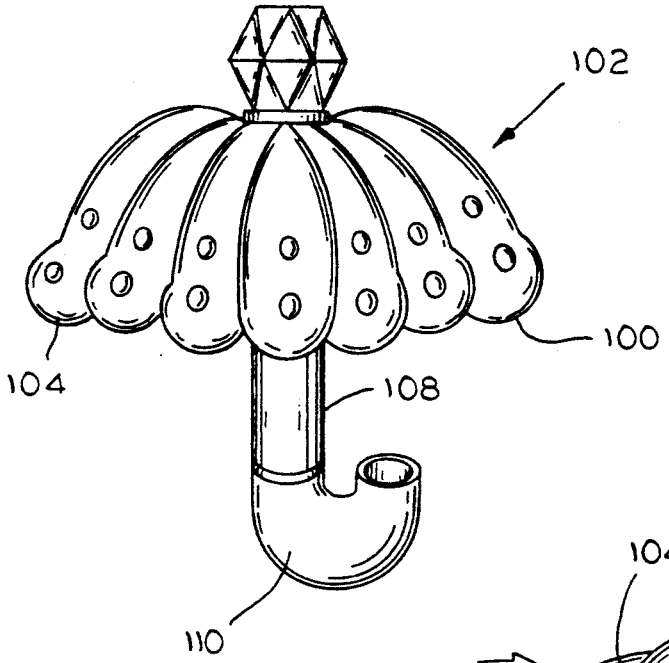
FIGS. 7A-7C illustrate a brooch in the form of a parasol having a squeeze pump.
Figure 7A:
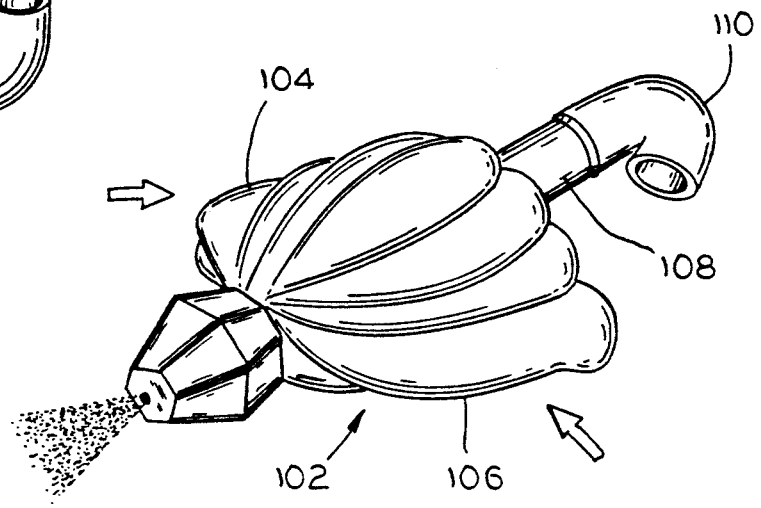
Figure 7C:
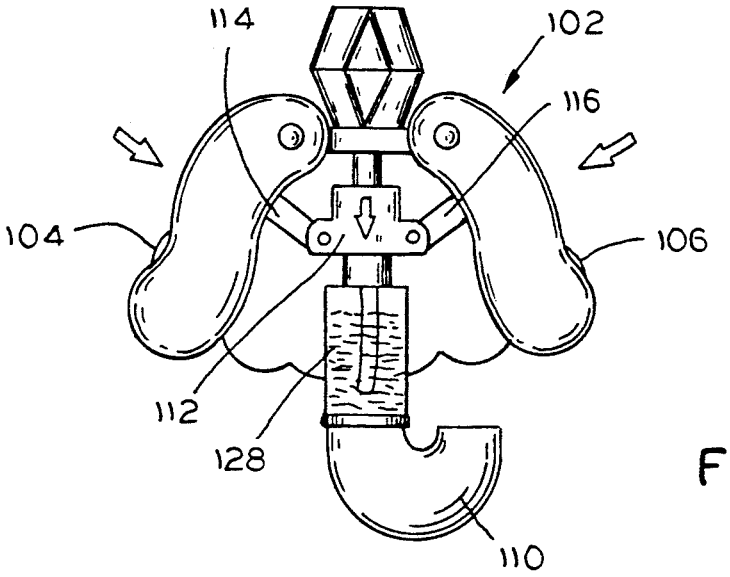

In FIGS. 7A-7C, a jewelry item is in the form of a parasol 102 having two pivoted members 104, 106. The water compartment 108 is filled by removing a stopper or by pulling or pushing a plunger controlled by handle at 110. The spray is actuated by squeezing together pivoted members 104, 106 which operates the pump via lever arms 114, 116.

Figure 8A:
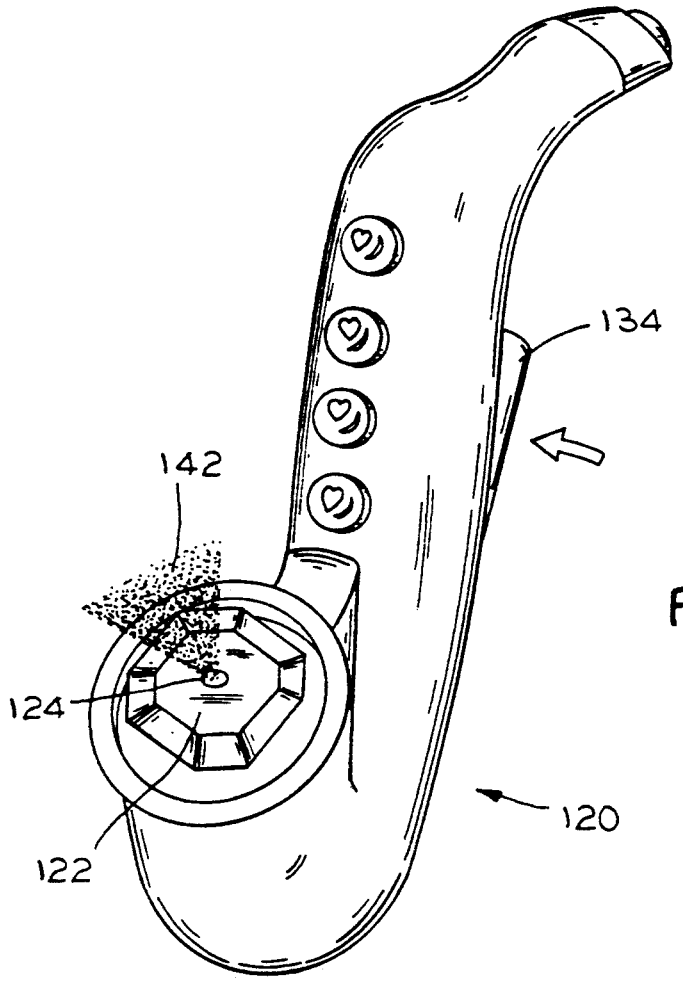
FIGS. 8A-8B show a brooch in the form of a saxophone with a lever controlled.
Figure 8B:
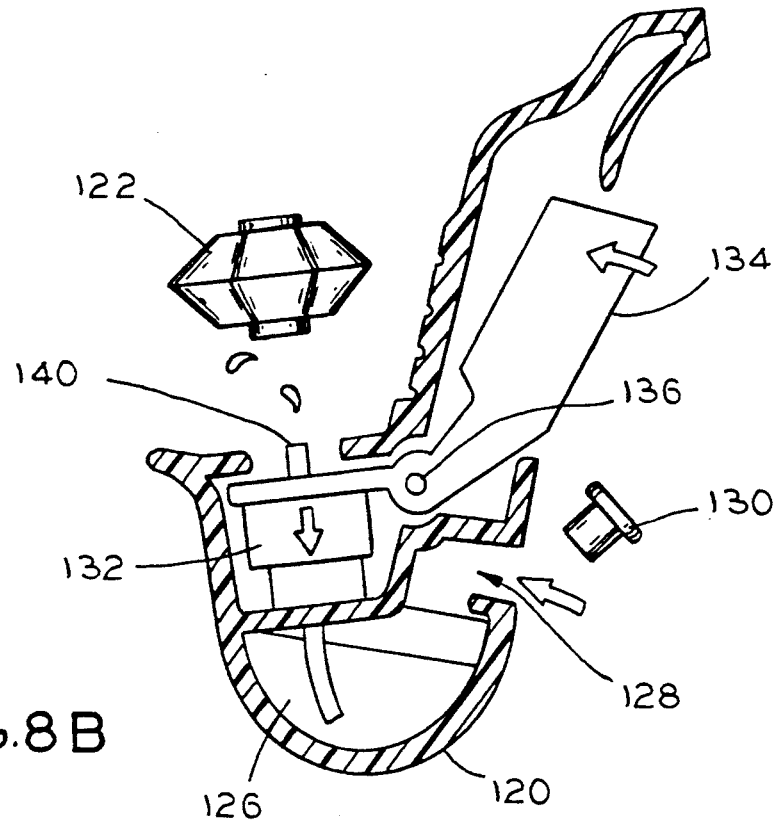
Figure 9A:
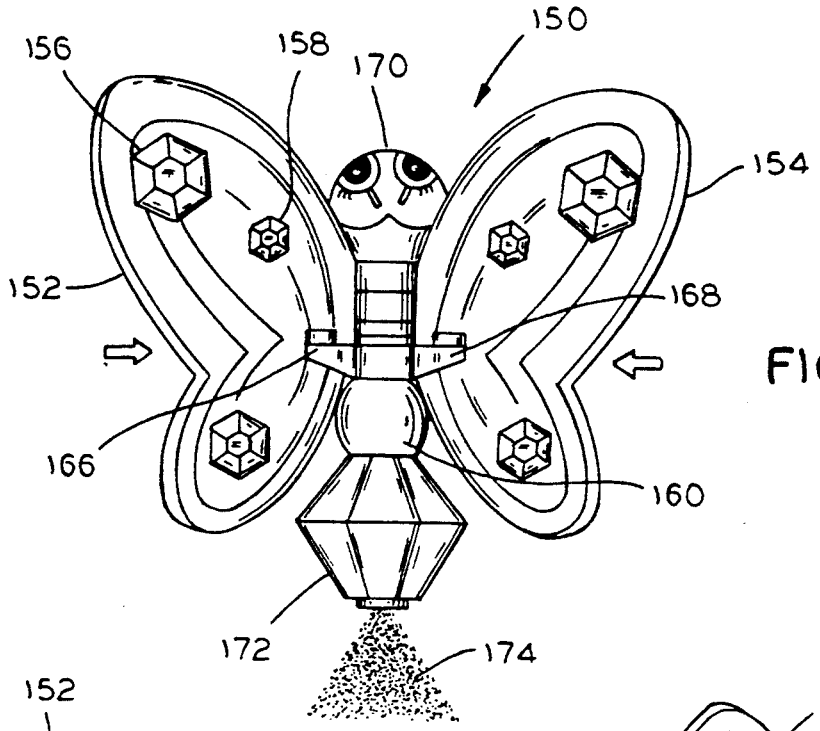
FIGS. 9A-9D show a brooch in the form of a butterfly with articulated wings to control a pump action.
Figure 9B:
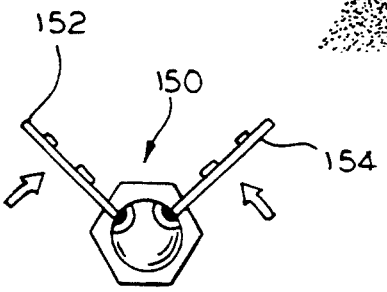
Figure 9C:
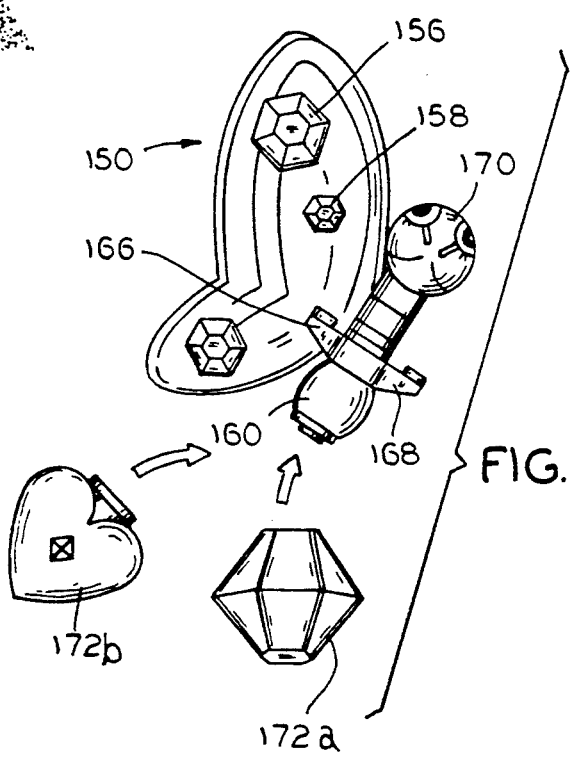
Figure 9D:
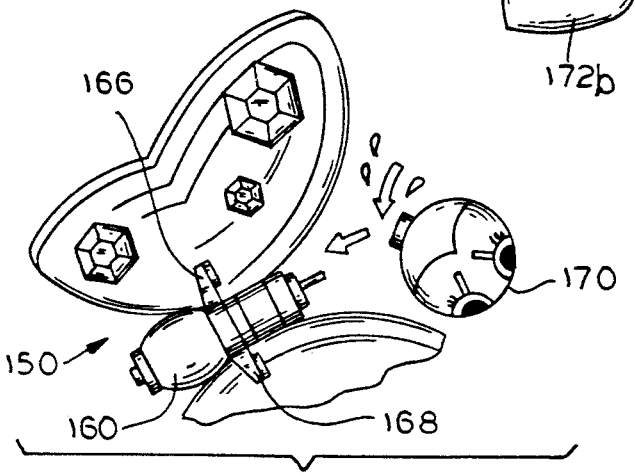

In FIGS. 8A-8C, a lever controlled costume jewelry item 120 is shown, by way of example, as having a shape suggestive of a saxophone. The bell of the saxophone containing a scented bead within jewel 122 having an aperture 124 through which scented water may issue. A water compartment 126 is built into the saxophone and filled through opening 128 which is closed by a suitable stopper 130. A pump 132 is operated by a lever or handle 134 which is pivoted at 136. The scent containing jewel 122 is built somewhat like a stopper to fit over a pipe 140 leading from pump 132. Hence, the jewel 124 may be replaced when its scent is exhausted. The scented spray 142 is delivered when the lever or handle 134 is pushed.

FIGS. 9A-9D illustrate a pin in the form of a butterfly 150. This embodiment includes two levers (herein they form wings 152, 154) which issue the spray when the wings are squeezed together. Suitable simulated jewels 156, 158 may be mounted at any suitable location, such as on the wings as here shown. This embodiment includes a centrally located atomizer pump 160 controlled via lever arms 166, 168 connected to the wings 152, 154. A water compartment 170 connects to one end of the pump 160. A replaceable jewel 172 containing a scented bead is connected to the other end of the water compartment. As shown at 172*a*, 172*b*, this jewel may be replaced when the scent is exhausted. When the wings 152, 154 are squeezed together, a scented spray 174 is delivered from the jewel 172.

Those who are skilled in the art will readily perceive how to modify the invention. Therefore, the appended claims are to be construed to cover all equivalent structures which fall within the true scope and spirit of the invention.

The claimed invention is:

1. A toy comprising a center surface in the form of a simulated jewelry item, a water compartment having means associated therewith to enable said compartment to be filled with water, a device for releasing a scent into said water as it bathes said device, means for spraying water from said compartment past said device in order to bathe it and for spraying the scented water into the ambient atmosphere, and means for supporting the toy as jewelry when worn on a human body.

2. The toy of claim 1 wherein said spraying means comprises an atomizer.

3. The toy of claim 2 wherein said water compartment is a container having a stopper which may be removed for filling said compartment with water and replaced after said filling.

4. The toy of claim 2 wherein said atomizer comprises a diaphragm simulating a jewelry surface which may be pushed to spray said water.

5. The toy of claim 2 wherein said device comprises a simulated jewel containing a scented bead, and a passageway for delivering water past said bead and out an aperture at the end of said passageway, said jewel being replaceably mounted on said item in order to replace said bead and renew the scent after it is exhausted.

6. The toy of claim 2 wherein said compartment filling means comprises a plunger for drawing water into said compartment.

7. The toy of claim 2 wherein said filling means comprises a separate chamber which may be plug-in connected onto said item.

8. The toy of claim 2 wherein said means for spraying is a pump, said atomizer comprises a pair of decorative members which may be moved, and levers connecting said members to said pump for delivering said spray.

9. The toy of claim 8 wherein said jewelry is in the form of a bow and arrow and said members are moved responsive to plucking a string on said bow in order to operate said pump.

10. The toy of claim 8 wherein said pair of members are clam shells which squeeze together in order to operate said pump.

11. The toy of claim 8 wherein said pair of members are wings which pivot to squeeze together in order to operate said pump.

12. The toy of claim 1 wherein said jewelry item is a wand or scepter, and finger controlled means on said wan or scepter for delivering a spray therefrom.

13. A toy to be worn by children, said toy comprising an outer shell having at least one decorative design simulating jewel, a water chamber, means for propelling water from said chamber as a fine mist discharged into an ambient atmosphere, means positioned between said chamber and said atmosphere for imparting a scent into the mist, and means for supporting and displaying said toy as an article of adornment on a human body.

14. The toy of claim 13 wherein said toy comprises a plurality of different articles having coordinated designs which may be mixed or matched to coordinate said adornment when said articles are worn by a child.

15. The toy of claim 14 wherein said articles are pieces of jewelry.

16. The toy of claim 14 wherein said articles are pendants, earrings, rings and pins.

* * * * *

UNITED STATES PATENT AND TRADEMARK OFFICE

CERTIFICATE OF CORRECTION

PATENT NO. : 5,316,182

DATED : May 31, 1994

INVENTOR(S) : Lee et al.

It is certified that error appears in the above-indentified patent and that said Letters Patent is hereby corrected as shown below:

On the title page, item [73], delete "G.J." and insert --C.J.--.

Signed and Sealed this

Sixth Day of December, 1994

*Attest:*

Bruce Lehman

BRUCE LEHMAN

*Attesting Officer*

*Commissioner of Patents and Trademarks*